United States Patent [19]

Sechrist et al.

[11] Patent Number: 4,988,430

[45] Date of Patent: Jan. 29, 1991

[54] SUPPLYING FCC LIFT GAS DIRECTLY FROM PRODUCT VAPORS

[75] Inventors: Paul A. Sechrist, Des Plaines; David A. Lomas; Daniel N. Myers, both of Arlington Heights, Ill.

[73] Assignee: UOP, Des Plaines, Ill.

[21] Appl. No.: 457,463

[22] Filed: Dec. 27, 1989

[51] Int. Cl.[5] ..... C10G 11/20

[52] U.S. Cl. ..... 208/113; 208/160; 208/161; 208/164; 208/150

[58] Field of Search ..... 208/113, 161, 160, 164, 208/120, 150

[56] References Cited

U.S. PATENT DOCUMENTS

| | | | |
|---|---|---|---|
| 3,244,617 | 4/1966 | Galbreath | 208/113 |
| 3,751,359 | 8/1973 | Bunn | 208/113 |
| 3,904,548 | 9/1975 | Fagan et al. | 208/164 |
| 4,036,779 | 7/1977 | Schatz et al. | 208/164 |
| 4,234,411 | 11/1980 | Thompson | 208/74 |
| 4,464,250 | 8/1984 | Myers et al. | 208/120 |
| 4,479,870 | 10/1984 | Hammershaimb et al. | 208/113 |
| 4,541,922 | 9/1985 | Lomas et al. | 208/113 |
| 4,541,923 | 9/1985 | Lomas et al. | 208/113 |
| 4,624,771 | 11/1986 | Lane et al. | 208/74 |
| 4,624,772 | 11/1986 | Krambeck et al. | 208/95 |
| 4,789,458 | 12/1988 | Haddad et al. | 208/164 |

FOREIGN PATENT DOCUMENTS

| | | | |
|---|---|---|---|
| 0187032 | 7/1986 | European Pat. Off. | 208/113 |
| 8203225 | 9/1982 | PCT Int'l Appl. | 208/113 |

*Primary Examiner*—Anthony McFarlane
*Assistant Examiner*—Nhat Phan
*Attorney, Agent, or Firm*—Thomas K. McBride; John G. Tolomei

[57] ABSTRACT

The use of lift gas for FCC risers is improved by the direct use of reactor vapors as the source of the lift gas. Reactor vapors recovered primarily from the stripping section of an FCC reactor/regenerator section provide an excellent source for lift gas material. These reactor vapors contain high concentrations of light paraffinic materials often with an equal weight percent amount of steam. The recovery of the stripping vapors independent from the product stream allows such gaseous mixtures to be readily processed for use as lift gas. The only processing requirements are the removal of particulate material and the compression of the gas to pressure conditions at the bottom of the riser. Compression of the gas requires a reduction in its temperature to suitable compressor inlet conditions. This invention is readily practiced in the most recent FCC reactor designs that separate the majority of product vapors from the catalyst in a closed riser cyclone arrangement. This invention is particularly suited for use in conjunction with hot catalyst stripping. Hot catalyst stripping produces a high concentration of very low molecular weight gas components in the effluent from the hot stripping zone which are highly suitable for use as lift gas material.

16 Claims, 3 Drawing Sheets

SUPPLYING FCC LIFT GAS DIRECTLY FROM PRODUCT VAPORS

FIELD OF THE INVENTION

This invention relates generally to processes for the fluidized catalytic cracking (FCC) of heavy hydrocarbon streams such as vacuum gas oil and reduced crudes. This invention relates more specifically to a method for reacting hydrocarbons in an FCC reactor and separating reaction products from the catalyst used therein.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium. The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. During the cracking reaction, coke will be deposited on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction tempertures change. That is, if it is desired to increase the conversion rate an increase in the rate of flow of circulating fluid catalyst from the regenerator to the reactor is effected. Since the catalyst temperature in the regeneration zone is usually held at a relatively constant temperature, significantly higher than the reaction zone temperature, any increase in catalyst flux from the relatively hot regeneration zone to the reaction zone affects an increase in the reaction zone temperature.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

As the development of FCC units has advanced, temperatures within the reaction zone were gradually raised. It is now commonplace to employ temperatures of about 525° C. (975° F.). At higher temperatures, there is generally a loss of gasoline components as these materials crack to lighter components by both catalytic and strictly thermal mechanisms. At 525° C., it is typical to lose 1% on the potential gasoline yield due to gasoline components thermally cracking into lighter hydrocarbon gases. As temperatures increase, to say 1025° F. (550° C.), most feedstocks lose up to 6% or more of the gasoline yield due to thermal cracking of gasoline components.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums if present upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser designs use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

In most reactor arrangements, catalysts and conversion products still enter a large chamber for the purpose of initially disengaging catalyst and hydrocarbons. A final separation of the hydrocarbon vapors from the catalyst is performed by cyclone separators that use centripetal acceleration to disengage the heavier catalyst particles from the lighter vapors which exit the reaction zone.

The benefits of using lift gas to pre-accelerate and condition regenerated catalyst in a riser type conversion zone are well known. Lift gas typically has a low concentration of heavy hydrocarbons, i.e. hydrocarbons having a molecular weight of $C_3$ or greater are avoided. In particular, highly reactive type species such as $C_3$ plus olefins are unsuitable for lift gas. Thus, lift gas streams comprising steam and light hydrocarbons are generally used.

The most readily available source for lift gas is from the gas concentration section of an FCC unit's product separation facilities. Taking lift gas from the gas concentration section places additional demands upon these facilities. Since the lift gas passes from the riser through the reactor and back to the gas concentration section, it is essentially a recycle stream. The additional throughput associated with the lift gas reduces the overall gas processing capabilities of the gas concentration facilities. Therefore, obtaining lift gas from the gas concentration section increases the cost of providing and maintaining the gas concentration section and where the gas concentration capacity limits the throughput through the FCC unit, the use of lift gas may be precluded or may reduce the amount of fresh feed processed in the FCC.

DISCLOSURE STATEMENT

U.S. Pat. No. 4,624,771, issued to Lane et al. on Nov. 25, 1986, discloses a riser cracking zone that uses fluidizing gas to pre-accelerate the catalyst, a first feed introduction point for injecting the starting material into the flowing catalyst stream, and a second downstream fluid injection point to add a quench medium to the flowing stream of starting material and catalyst.

U.S. Pat. No. 4,624,772, issued to Krambeck et al. on Nov. 25, 1986, discloses a closed coupled cyclone system that has vent openings, for relieving pressure surges, that are covered with weighted flapper doors so that the openings are substantially closed during normal operation.

U.S. Pat. No. 4,234,411, issued to Thompson on Nov. 18, 1980, discloses a reactor riser disengagement vessel and stripper that receives two independent streams of catalyst from a regeneration zone.

U.S. Pat. No. 4,479,870, issued to Hammershaimb et al. on June 30, 1984, teaches the use of lift gas having a specific composition in a riser zone at a specific set of flowing conditions with the subsequent introduction of the hydrocarbon feed into the flowing catalyst and lift gas stream.

U.S. Pat. No. 4,464,250, issued to Maiers et al. and U.S. Pat. No. 4,789,458, issued to Haddad et al. teach the heating of spent catalyst particles to increase the removal of hydrocarbons, hydrogen and/or carbon from the surface of spent catalyst particles by heating the catalyst particles after initial stripping of hydrocarbons in the stripping zone of an FCC unit.

BRIEF DESCRIPTION OF THE INVENTION

It is an object of this invention to minimize or eliminate the recycle of lift gas through the gas concentration section of an FCC unit.

It is a further object of this invention to provide a direct source of lift gas from the reactor regeneration section of an FCC unit.

This invention is a process that uses vapors from an FCC stripping zone as the source of lift gas for a riser reaction zone. Appropriate off gas streams that can be easily processed to serve as a lift gas stream can be made available by selecting a proper arrangement of reactor internals or catalyst stripping facilities. A reactor with cyclones that are directly connected to a reactor riser to receive the effluent from the riser will isolate a majority of the hydrocarbon products from a reactor disengagement vessel. Such a reaction zone can be arranged to use the stripping stream and stripped vapors from the catalyst as a lift gas source stream. It is also possible to arrange a multiple stage stripping section such that an isolated stream of stripping medium and stripped materials are recovered as a lift gas source from one of the stages of stripping. These stripping gases make excellent lift gas sources since they already contain a high concentration of steam—the typical lift gas is approximately half steam. The hydrocarbon make-up of the stripped gases also facilitates their use as a lift gas source since long exposure to the catalyst at high temperatures has cracked essentially all of the hydrocarbon components to light gases. These sources of lift gas only require cooling, treating to remove solid materials and recompression in order to be returned to the reactor riser as lift gas. The amount of steam and light gas material entering the main column and gas concentration section of the FCC unit is directly reduced by the amount of such vapors that are processed as lift gas. Thus, this invention provides an overall reduction in the size and operating costs of the gas concentration section for an FCC unit.

Accordingly in one embodiment, this invention is a process for the fluidized catalytic cracking of hydrocarbons. The process comprises contacting hot regenerated catalyst particles, lift gas and an FCC feed in an upstream end of a riser conversion zone at hydrocarbon conversion conditions. The effluent mixture from the riser conversion zone including hydrocarbon vapors, steam and spent catalyst particles is passed from a downstream end of the riser to a fluid solid separator that separates hydrocarbon vapors and steam from the spent catalyst particles. The spent catalyst particles enter a stripping zone where they are contacted with a stripping fluid such as steam to displace adsorbed material from the surface of the particles. A gaseous mixture made up of desorbed material from the catalyst and stripping fluid is collected. The gaseous mixture is cooled and solid particles are separated from the mixture. When the mixture is cooled sufficiently and essentially all of the solid particles have been removed, the mixture is compressed and passed to the riser conversion zone as the lift gas.

In a more complete embodiment, this invention is a process for the fluidized catalytic cracking of hydrocarbons in a riser type conversion zone. The process comprises contacting regenerated catalyst in an upstream portion of the riser type conversion zone with a lift gas comprising hydrocarbons and steam and contacting the mixture of regenerated catalyst and lift gas with an FCC feedstock in the riser conversion zone at a location downstream of where the lift gas and catalyst come in contact. The lift gas introduced into the riser comprises $C_3$ and lower molecular weight hydrocarbons. An effluent mixture comprising the lift gas, hydrocarbons and spent catalyst is discharged from the downstream end of the riser type conversion zone. The downstream end of the riser type conversion zone is located in a reactor vessel. The effluent mixture is collected in a separator that separates spent catalyst from the effluent mixture. The separated effluent mixture is withdrawn from the reactor vesse. The spent catalyst is passed downwardly from the reactor vessel into a stripper vessel and contacted counter-currently with a stream of stripping steam to remove adsorbed hydrocarbons from the surface of the catalyst. Stripped catalyst is withdrawn from the bottom of the stripper vessel. The steam and hydrocarbons desorbed from the surface of the catalyst are passed upwardly into the reactor vessel and withdrawn as a gaseous mixture having a temperature of at least 850° F. The gaseous mixture comprising steam and material stripped from the catalyst is withdrawn out of an upper section of the reaction vessel. The gaseous mixture is cooled by indirect heat exchange with feed water to generate steam and produce a cooled mixture having a temperature of less than 650° F. The cooled mixture is contacted with a water stream to produce a quenched mixture having a temperature of less than 300° F. and to scrub solid particles from the quenched mixture. Condensed liquid from the quenched mixture is separated in a separator to remove liquid and solids and produce a separator gas stream. The separator gas stream is compressed to a pressure of between 15 to 50 psig and combined with steam to produce the previously described lift gas that is introduced into the riser.

Other objects, embodiments and details of this invention can be found in the following detailed description of the invention.

DETAILED DESCRIPTION OF THE INVENTION

Figure 1:
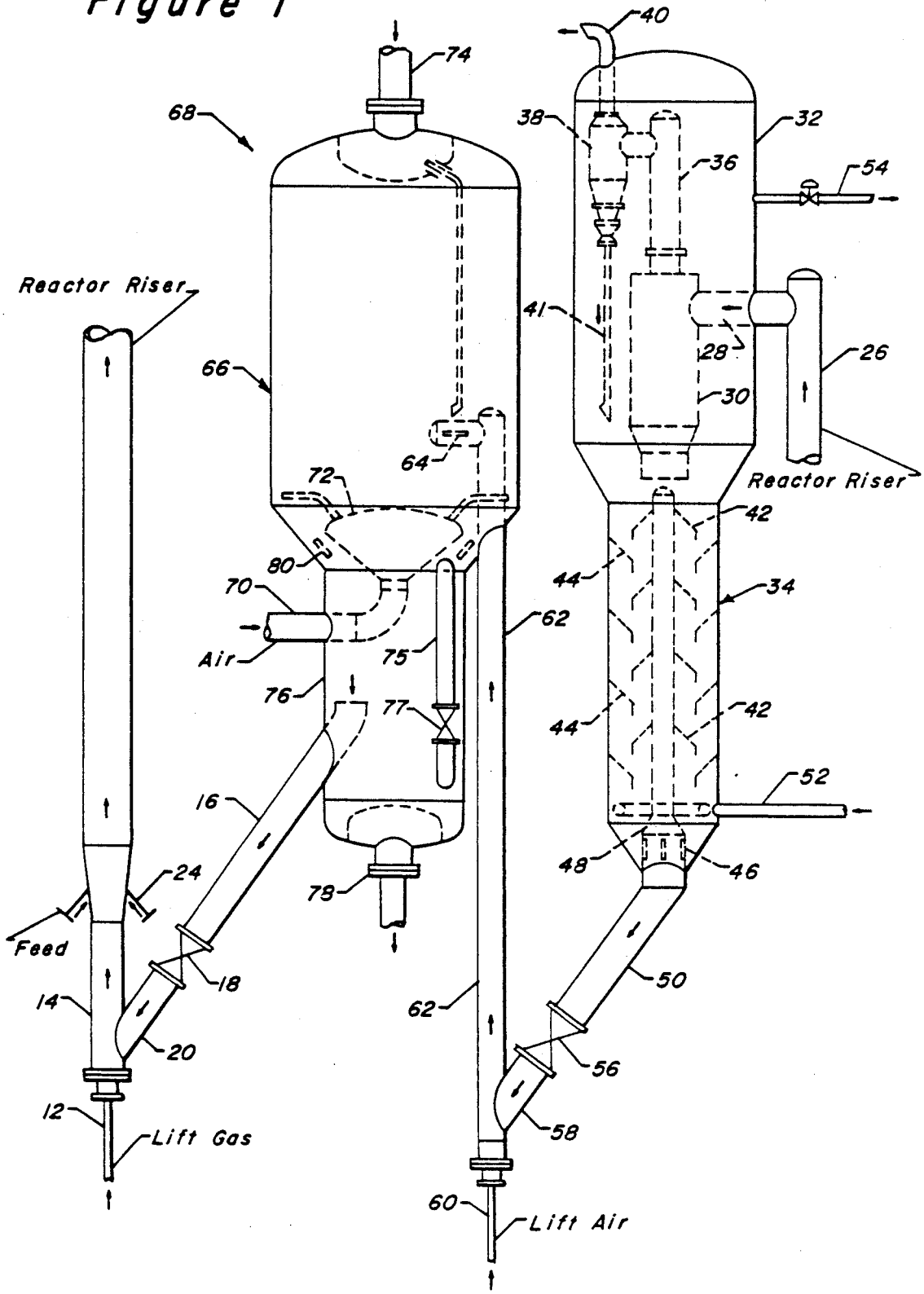
FIG. 1 is a schematic view showing the internals of an FCC reactor/regenerator section.

The process and apparatus of this invention will be described with references to the drawings. Reference to the specific configurations shown in the drawings is not meant to limit the process of this invention to the particular details of the drawings disclosed in conjunction therewith. Looking first at the operation of the riser conversion zone, a lift gas stream enters an inlet conduit 12 that passes the lift gas into the lower portion of a riser 14. Hot catalyst from a regenerated standpipe 16 passes through a control valve 18 and is mixed with the lift gas in a junction between the standpipe and lower riser generally referred to as a Y-section and denoted as 20 on the Figure. Lift gas carries the catalyst up the riser from lower section 14 to upper riser section 22 and conditions the catalyst by contact therewith. Between the upper and lower riser section, feed nozzles 24 inject hydrocarbon feed into the flowing stream of catalyst and lift gas. Hydrocarbon feed is converted as it travels to the end 26 of the riser. At the top 26, the riser ends with an abrupt change of direction that directs the mixture of converted feed components and catalyst into transfer conduit 28.

The catalyst which enters the riser and can be used in the process of this invention include those known to the art as fluidizing catalytic cracking catalysts. These compositions include amorphous clay type catalysts which have for the most part been replaced by high activity crystalline alumina silicate or zeolite containing catalysts. Zeolite catalysts are preferred over amorphous type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, aluminum, or zirconium. These catalyst compositions may have a zeolite content of 30% or more.

Feeds suitable for processing by this invention, include conventional FCC feedstocks or higher boiling hydrocarbon feeds. The most common of the conventional feedstocks is a vacuum gas oil which is typically a hydrocarbon material having a boiling range of from 650°-1025° F. and is prepared by vacuum fractionation of atmospheric residue. Such fractions are generally low in coke precursors and heavy metals which can deactivate the catalyst.

This invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

The finely divided regenerated catalyst entering the bottom of a reactor riser leaves the regeneration zone at a high temperature usually in the range of 1200°-1400° F. Where the riser is arranged vertically, the bottom section will be the most upstream portion of the riser. In most cases, the riser will have a vertical arrangement, wherein lift gas and catalyst enter the bottom of the riser and converted feed and catalyst leave the top of the riser. Nevertheless, this invention can be applied to any configuration of riser including curved and inclined risers. The only limitation in the riser design is that it provide a substantially smooth flow path over its length.

Contact of the hot catalyst with the lift gas accelerates the catalyst up the riser in a uniform flow regime that will reduce backmixing at the point of feed addition. Reducing backmixing is important because it varies the residence time of hydrocarbons in the riser. Addition of the lift gas at a velocity of at least 3 feet per second is necessary to achieve a satisfactory acceleration of the catalyst. The lift gas used in this invention is more effective when it comprises $C_3$ and lower molecular weight hydrocarbons and particularly when it includes not more than 10 mol % of $C_3$ and heavier olefinic hydrocarbons. Low molecular weight hydrocarbons in the lift gas are believed to selectively passivate active metal contamination sites on the catalyst to reduce the hydrogen and coke production effects of these sites. Selectively passivating the sites associated with the metals on the catalyst leads to greater selectivity and lower coke and gas yield from a heavy hydrocarbon charge. Some steam may be included with the lift gas and, in addition to hydrocarbons, other reaction species may be present in the lift gas such as $H_2$, $H_2S$, $N_2$, CO, and/or $CO_2$. However, to achieve maximum effect from the lift gas, it is important that appropriate contact conditions are maintained in the lower portion of the riser. A residence time of 0.5 seconds or more is preferred in the lift gas section of the riser, however, where such residence time would unduly lengthen the riser, shorter residence times for the lift gas and catalyst may be used. A weight ratio of catalyst to hydrocarbon in the lift gas of more than 80 is also preferred.

After the catalyst is accelerated by the lift gas, it enters a downstream portion of the riser which is generally referred to as the upper section. Feed may be injected into the start of the section by nozzles as shown in the Drawing or any device that will provide a good distribution of feed over the entire cross-section of the riser. Atomization of the feed, as it enters the riser, promotes good distribution of the feed. A variety of distributor nozzles and devices are known for atomizing feed as it is introduced into the riser. Such nozzles or injectors may use homogenizing liquids or gas which are combined with the feed to facilitate atomization and dispersion. Steam or other non-reactive gases may also be added with the feed, for purposes of establishing a desired superficial velocity up the riser. The superficial velocity must be relatively high in order to produce an average residence time for the hydrocarbons in the riser of less than 5 seconds. Shorter residence times permit the use of higher reaction temperatures and provide additional benefits as discussed below; thus where possible the feed has a residence time of 2 seconds or less. In more limited embodiments of this invention, the residence time may be less than 1 second.

The catalyst and feed mixture has an average temperature in a range of from 850°-1050° F. A combination of a short residence time and higher temperatures in the riser shifts the process towards primary reactions. These reactions favor the production of gasoline and tend to reduce the production of coke and light gases. Furthermore, a higher temperature rise gasoline octane. A short catalyst residence time within the riser is also important for maintaining the shift towards primary reactions and removing the hydrocarbons from the presence of the catalyst before secondary reactions that favor coke and light gas production have time to occur.

The high velocity stream of catalyst and hydrocarbons is then rapidly separated at the end of the riser. This can be accomplished by passing directly into a cyclonic separation system or the riser can be configured so as to abruptly change direction before this initial separation. The separated vapors begin their path toward the product recovery zone while the separated catalyst is directed toward the stripping zone.

FIG. 1 shows an arrangement where transfer conduit 28 directs the product vapor and spent catalyst directly into a disengaging chamber 30. The disengaging chamber 30 is located wholly within a reactor vessel 32. Transfer conduit 28 extends through the wall of vessel 32. Transfer conduit 28 may be arranged so that the catalyst and product vapor mixture enters the disengaging chamber tangentially or on a path that intersects the center line of the disengaging chamber. Directing the catalyst and product vapor mixture tangentially into the disengaging chamber 30 promotes additional separation of catalyst from the vapors by having chamber 30 operate as a preliminary cyclone. Product vapors that are disengaged from the catalyst rise upwardly in conduit 36 while disengaged catalyst falls downwardly into a hereinafter described stripping section 34. Conduit 36 carries the product vapors which still contained entrained catalyst particles into a cyclone 38. Cyclone separator 38 is directly coupled to conduit 28 so that product vapors travel from the riser in close communication through the disengaging chamber 30 to conduit 36 and into cyclone 38. Cyclone separator 38 performs a final separation of product vapors from catalyst particles and directs the product vapor out of the reactor vessel 32 through a conduit 40. Product vapors from conduit 40 are carried overhead to the main column of the FCC separation facilities. Product vapor entering the main column may still have a small concentration of the solid particles which are removed by solids separation equipment within the FCC separation section.

Catalyst separated in cyclone 38 is transferred downwardly in a dip leg 41 and discharged therefrom to combine with catalyst from disengaging chamber 30. Catalyst from dip leg 41 and disengaging chamber 30 collect at the top of the stripper section 34 which is located below the reactor vessel 32. Stripping zone 34 is arranged principally vertically and has a number of vertically spaced baffles 42 that extend outwardly and downward from a center support pipe 44 and another set of vertically spaced baffles 44 that are offset from baffles 42 and extend inwardly and downwardly from the outer wall of stripper 34. Catalyst is withdrawn from the bottom of stripper 34 through openings 46 in a collection pipe 48 that transfers spent catalyst to a spent catalyst conduit 50. As catalyst is withdrawn from the bottom of the stripper, baffles 42 and 44 allow the catalyst to cascade from side to side. The movement of the catalyst increases contact between the catalyst and steam that enters the bottom of the stripper 34 through a distributor ring 52.

The removal of spent catalyst from stripping zone 34 is controlled by valve 56 which regulates catalyst flow into a Y section 58 wherein catalyst is contacted with air from a line 60 and transported upwardly through a riser 62 and discharged through a discharge device 64 into an upper portion 66 of a regenerator vessel 68. Compressed air from a line 70 is distributed through a distributor 72 over the cross-section of upper regenerator section 66 to combust coke from the surface of the catalyst and perform a partial regeneration of the catalyst. The by-products of coke combustion consisting primarily of CO and $CO_2$ are separated from the catalyst and withdrawn overhead through a line 74. Partially regenerated catalyst is transferred from upper section 66 to a lower section 76 through a catalyst conduit 75 at a rate regulated by a valve 77. In a lower section 76 a further quantity of compressed air is distributed over the cross-section of lower regenerator section 76 by a distributor 78. Additional contact of the catalyst with the air stream performs a complete regeneration of the catalyst in the lower section by removing any coke that was not completely combusted in upper section 66 from the surface of the catalyst in lower section 76. Entrained catalyst and flue gas from the lower section 76 passes into upper section 66 through gas vents 80. Hot regenerated catalyst is withdrawn from lower section 76 and mixed with the lift gas in a manner previously described. Specific methods of transferring catalyst from a stripping section to a regeneration zone, regenerating the catalyst and returning catalyst to a reactor riser are well known to those skilled in the art and any such methods may be used in conjunction with a reaction section that uses lift gas obtained in accordance with this invention.

The stripping gas is added to stripper 34 below the lowermost grid 44. After the stripping gas contacts the catalyst, it becomes mixed with hydrocarbon vapors that have been stripped from the catalyst. The stripping gas is usually steam which will be added to the stripping vessel in an amount equaling 0.5 to 2 wt. % of the feed charged to the riser. In the stripping zone, as shown in FIG. 1, the stripping zone operates at about the same temperature as that of the catalyst and product leaving the riser. At these temperatures, contact of the catalyst with the stripping gas will remove readily strippable hydrocarbons from the catalyst surface. As gas and vapors continue to rise in the stripper, counter-currently to the flow of catalyst, the concentration of hydrocarbons in the stripping gas increases. At the end of the stripping zone 34, a small portion of the stripping gas will flow into reactor vessel 32. The passage of a majority of the stripping gas into disengaging chamber 30 is caused by the slightly higher pressure that is maintained in reactor vessel 32 relative to that at the end of riser 26 and in disengaging chamber 30. This slightly higher pressure keeps hydrocarbon product from flowing out of disengaging chamber 38 or dip leg 41 where it would tend to be overcracked by continued exposure to heat and catalyst.

Passage of the stripping gas through the stripping zone gives it an ideal composition as a source for lift gas. The long exposure of hydrocarbons to heat and catalyst cracks the majority of these hydrocarbons to $C_3$ and lighter paraffins. Typically, the lift gas will contain between 30–70% light paraffinic hydrocarbons. The hydrocarbons and stripping gas that enter reactor vessel 32 are withdrawn from the reaction zone through a vent line 54.

Once the source of the lift gas has been withdrawn from the reactor, it must be further processed so that it can be compressed and recycled to the riser. A gaseous mixture of stripping steam, stripped hydrocarbons and other materials removed from the catalyst form a gaseous mixture that is still at reactor temperature and contains solid particles. The solid particles must be removed and the gaseous mixture must be cooled before it can be recompressed. The reactor temperature mixture may be cooled by indirect heat exchange, direct quenching or a combination thereof. There are also several ways to remove the solid particles such as separation in a cyclone type separator or scrubbing with a liquid stream. A water quench is particularly preferred for reducing the temperature of the gaseous mixture since it will cool the mixture with minimal equipment cost and the liquid droplets from the quenching will scrub solids from the vapor phase of the gaseous mixture. An added benefit of quenching is the direct production of steam from the quench water which may be useful to provide a desired steam to hydrocarbon ratio for the lift gas in the riser. However, cooling all of the gaseous mixture by the use of a quench may produce excessive amounts of admixed steam and require a large separator to remove condensed material from the vapor components. Therefore, a combination of indirect heat exchange and quenching is believed to offer the best method of cooling the gaseous mixture.

Figure 2:
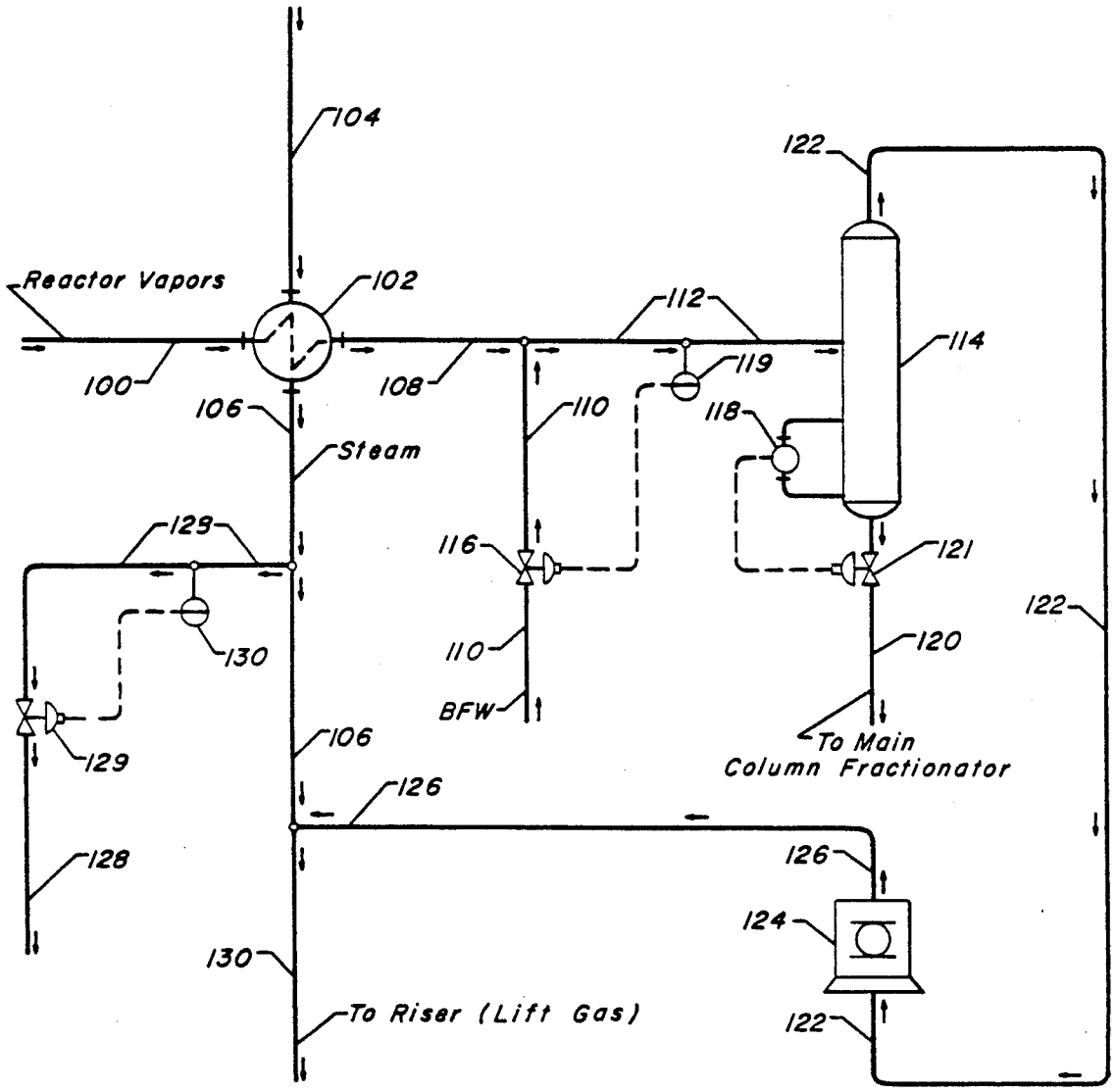
FIG. 2 is a flow diagram for treating a lift gas source obtained from a reactor/regenerator section.

A method that combines indirect heat exchange with direct quenching to cool the gaseous mixture is shown in FIG. 2. Reactor vapors from a line 100 enter an indirect heat exchange section 102 wherein heat is transferred to boiler feed water that enters exchanger 102 through a line 104 and generates steam that is recovered by line 106. The reactor vapors in a temperature range of from 850°–1150° F. are cooled in exchanger 102 to a temperature of less than 650° F. and withdrawn by a line 108.

The cooled vapors are further reduced in temperature by quenching with a water stream. The water is mixed with the cooled vapors in an amount that will reduce the temperature of the cooled stream to a temperature suitable for a compressor inlet. This temperature will usually be below 300° F. A number of nozzles and distribution devices are known for mixing liquid with a vapor and any such device that provides the desired degree of contact between the liquid and gas stream may be used. The amount of water flow needed to cool the effluent in most cases is relatively low and is on an order of about 1.5 to 2.0 lbs./barrel of feed to the FCC riser. FIG. 2 shows the mixing of boiler feed water from a line 110 with the cooled mixture from line 108 to form a quenched mixture carried by line 112 into a separator 114. The amount of boiler feed water added by a line 110 is controlled by a control valve 116 that responds to a temperature controller 119 for controlling the temperature in separator 114.

The addition of the quench water and the use of separator 114 allows essentially all of the solid particles to be removed from the quenched stream. The quench mixture contains liquid water and other condensables that scrub the solid particles from the gaseous components of the mixture. The solid particles remain in suspension with the liquid as it enters separator 114. The liquid water and other condensables can be withdrawn from the bottom of the separator through a line 120 while the gaseous components that are relatively free of solid materials are taken by line 122 from the top of separator 114 to the inlet of compressor 124. A control valve 121 across line 120 responds to a level controller 118 that senses the level in separator 114. The liquid stream 120 is usually 0.1 to 0.5 lbs./barrel of feed to the riser and is readily treated in the main column fractionator of the FCC separation section which separates the water and recovers the solids for recycle or removal.

The cooled gas that enters compressor 124 must be compressed to riser inlet conditions. These conditions require a presssure approximately 10 psi higher than the reactor pressure. This typically requires compression of the gas to about 15 to 50 psi. Since the gas concentration section of the FCC separation section usually compresses gas to about 200 psi, there is a significant energy savings in processing the lift gas stream to a lower pressure independent of the gas concentration section.

Compressed gas is taken by line 126 and combined with steam from heat exchanger 102. Where the gaseous mixture of reactor vapors have a very high temperature, the amount of steam produced in exchanger 102 may exceed the requirements for lift gas. Where there is excess steam, it may be used for other purposes. FIG. 2 shows a line 128 for withdrawing the excess steam carried by line 106. The withdrawal of excess steam is regulated by a valve 129 in response to a pressure indicator 130 The recompressed gas and steam mixture is carried by line 130 for use as lift gas in a reactor riser.

Figure 3:
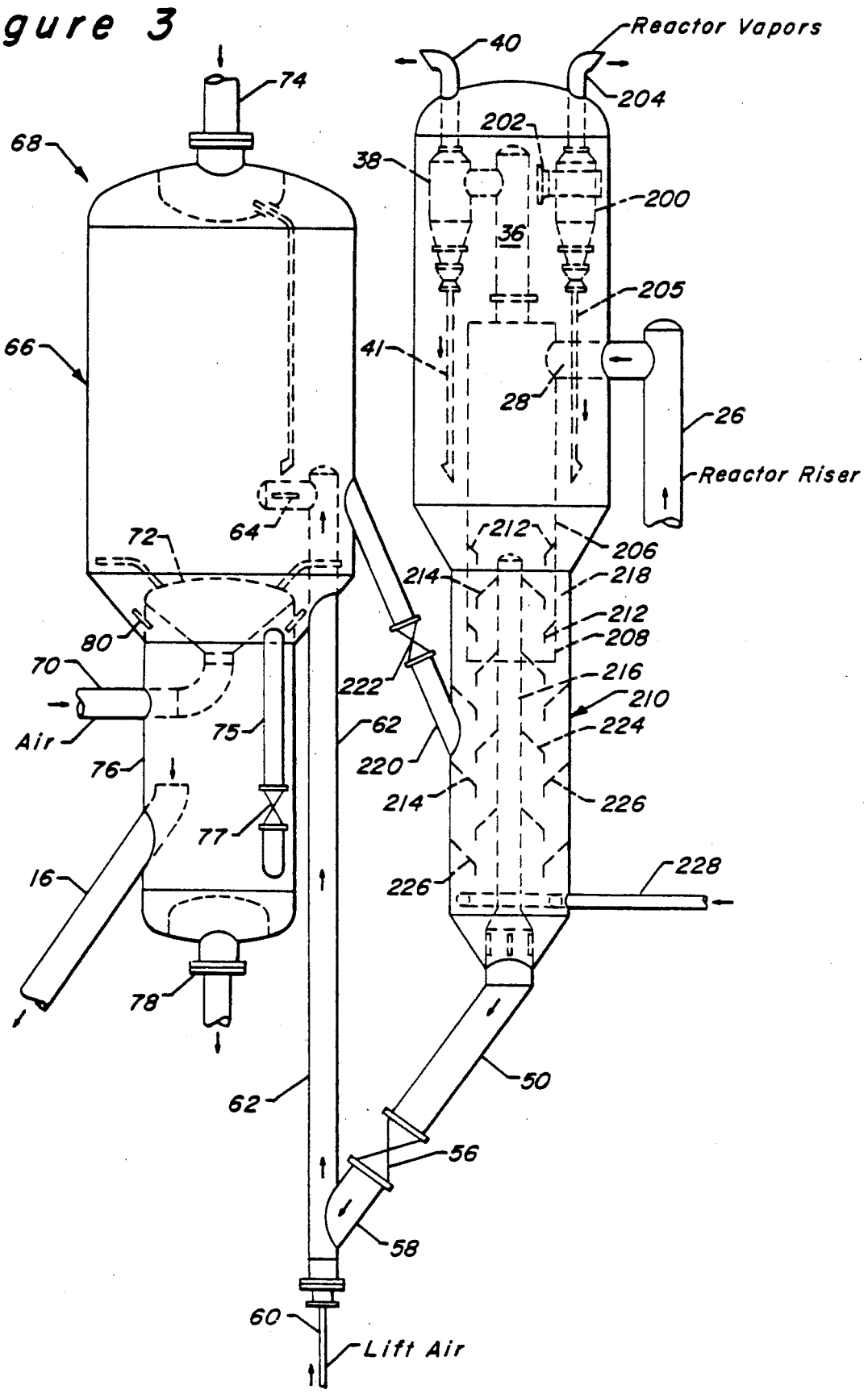
FIG. 3 shows the reactor of FIG. 1 modified to include a hot stripping section and a cyclone for removing catalyst particles from the lift gas source vapor.

Loading of entrained catalyst particles that are removed from the reactor in the gaseous stream can be relatively high. A cyclone type separator can be used to reduce the catalyst loading in the gaseous mixture before it undergoes any cooling. Such removal of particles is carried out before cooling to prevent any condensible material from interfering with the operation of a cyclone separator. The most advantageous location for such a separator is inside the reactor vessel so that the separated catalyst particles may be returned directly to the catalyst stripper. Such an arrangement is shown in FIG. 3 where a cyclone 200 is located in the top of the reactor vessel. Cyclone 200 has an inlet 202 that receives the gaseous mixture of stripping gas, stripped material from the catalyst and entrained catalyst particles. The gaseous mixture having a reduced catalyst loading is withdrawn from the top of the cyclone through a conduit 204 and passed to a processing system such as that previously described for further treatment of the lift gas source material. The separated catalyst particles are returned to the stripping bed to a dip leg 205.

FIG. 3 also shows a further embodiment wherein this invention is used in conjunction with a hot stripping section. Hot catalyst stripping refers generally to the operation of a catalyst stripper at a temperature above the usual reactor temperature. In normal operation, this means that the stripper will have a temperature above at least 975°. Greater advantages are obtained when the stripper is maintained above 1000° F. The temperature in the stripping section may be raised by a variety of methods. Such methods include heating coils and the introduction of hot regenerated catalyst into the stripping zone. Hot catalyst stripping may also be carried out using a multi-stage stripping vessel wherein a first stripping section operates at a temperature equal to that of the catalyst and product mixture leaving the top of the riser. This first stripping section removes less highly adsorbed hydrocarbon components from the catalyst surface before they are substantially overcracked and still have substantial product value. Catalyst from the first stripping section is then passed to the higher temperature hot stripping section which further removes hydrocarbons, hydrogen and strippable coke. In such an arrangement, the secondary hot stripping arrangement removes combustible material that if left on the catalyst would interfere with the regeneration process by increasing the amount of combustible material entering the regeneration zone and the heat released by the regeneration process. The high temperature stripping operation leaves mainly graphitic coke on the catalyst surface. The gas stream removed from the secondary stripping zone consists primarily of steam, highly cracked hydrocarbons and hydrogen. Because of the higher temperatures and longer duration of catalyst contact, the gas removed from a hot stripping zone has a very low molecular weight and is highly suitable as lift gas. Therefore, in the case of a stripper arranged with a separate hot stripping section, it is highly desirable to recover the gas from the hot stripping section independently for use as the lift gas source material. FIG. 3 shows an arrangement for a 2-stage stripper that provides separate recovery of the stripping gas from the hot stripping zone. Apart from the stripping section and the addition of the cyclone for the separation of solid particles from the lift gas source material, the reactor/regenerator system shown in FIG. 3 operates in essentially the same manner as that described for FIG. 1. Catalyst from transfer conduit 28 falls to the bottom of a disengaging chamber 206 as product vapors are withdrawn overhead. Disengaging chamber 206 has a lower section 208 that extends approximately midway into a catalyst stripper vessel 210. Several vertically spaced baffles 212 extend inwardly and downwardly from the inside of chamber section 208. Another set of baffles 214, in offset relationship to baffles 212, are arranged vertically along the upper section of a support pipe 216 and extend outwardly and downwardly from the support pipe. Catalyst from the disengaging chamber 206 flows downwardly and is forced from side to side as it passes over baffles 212 and 214. At the bottom of chamber section 208, catalyst passing out of the disengaging chamber is mixed with catalyst particles from the cyclones in the reactor vessel and hot regenerated catalyst from the regeneration zone. Catalyst from the upper part of the reactor vessel flows downwardly to the outside of chamber section 208 through an annular area 218. The hot regenerated catalyst enters the stripping vessel 210 at about its midpoint through a regenerated catalyst transfer line 220 that delivers hot regenerated catalyst from the regenerator 66 in an amount regulated by a control valve 222. The amount of hot regenerated catalyst mixed with spent catalyst from the reactor is sufficient to raise the temperature of the catalyst mixture in the lower portion of the stripper to a temperature in a range of from 1000°-1150° F. A lower portion of support pipe 216 has another set of baffles 224 that extend outwardly and downwardly therefrom. A set of outer baffles 226 are vertically offset from baffles 224 and extend inwardly and downwardly from the outer wall of stripper 210. As catalyst is withdrawn from the stripper through conduit 50 in the manner previously described, catalyst passing across baffles 224 and 226 moves from side to side. Stripping fluid in the form of steam is added through a distributor ring 228 which rises through the stripper counter-current to catalyst flow. As the mixture of steam and stripping materials rise up in the stripper to the level of baffle 208, a portion of the steam and stripped gas flows upwardly into disengaging chamber 206. The stripping gas mixture passing to the inside of disengaging chamber 206 supplies the necessary stripping medium for the removal of the less adsorbed hydrocarbons from the surface of the catalyst. All of the gaseous material entering disengaging chamber 206 is ultimately recovered from the reactor through conduit 40 and transferred to the main column of the FCC separation section. Any stripping gas and stripped material that does not enter disengaging chamber 206 rises counter-currently to catalyst flow through annular section 208 and collects at the top of the reactor vessel 34. The gaseous mixture at the top of reactor 34 supplies the lift gas source material that is removed by cyclone 200 in the manner previously described.

EXAMPLE

The following example shows the use of an FCC reactor of the type shown in FIG. 3 and the recovery of the gaseous mixture from the top of the reactor vessel for use as a lift gas source material and the processing of the gaseous material for use as lift gas. This example is based on engineering calculations and operating data obtained from similar components and operating FCC units.

An FCC unit is operated to process 30,000 barrels/-stream day of a vacuum gas oil feed. The feed is contacted with a catalyst and lift gas mixture in the bottom of a reactor riser and enters a reactor vessel that operates at a pressure of about 30 psig. The composition of the lift gas based on the feed is approximately 1.5 wt. % steam and 1.5 wt. % light hydrocarbon. Product hydrocarbons are disengaged from the catalyst in the disengaging chamber and a riser cyclone. The catalyst travels downwardly through a first stage of a stripping section that operates at approximately the same temperature as the upper end of the reactor riser. As the catalyst passes out of first stage of the stripping section, it is mixed with hot regenerated catalyst from a regeneration zone in an amount sufficient to raise the temperature of the catalyst from the 975° F. operating temperature of the reactor riser to about 1150° F. Catalyst passing through the stripper is contacted with gas that enters the bottom of the stripper. The stripping gas first contacts the spent catalyst and regenerated catalyst mixture in the lower section of the stripper. The stripping gas removes adsorbed hydrocarbons from the surface of the catalyst and the stripping gas becomes mixed with light paraffins and hydrogen. A quantity of stripping gas mixture equal to approximately 2 wt. % of the reactor feed is separated from the gases and vapors passing upwardly from the lower section of the stripper and are collected in an upper section of a reactor vessel. The gaseous mixture in the upper portion of the reactor vessel passes through a cyclone separator that reduces the loading of catalyst particles in the gaseous mixture.

After removal from the reactor, the gaseous mixture is first cooled by passage through an indirect heat exchanger that reduces its temperature to 600° F. while producing 3150 lbs. per hour of 300 psig steam from boiler feed water. The amount of steam produced is equal to approximately to 0.75 wt. % of the feed. Approximately two thirds of the 0.75 wt. % steam produced by indirect heat exchange is used to inject feed into the FCC. A cooled gaseous mixture from the heat exchanger is mixed with water which quenches the mixture to a temperature of about 234° F. Quenching of the gaseous mixture to this temperature produces a liquid water and hydrocarbon phase. The water vaporized during the quenching increases the steam in the quench mixture from 1 wt. % to 1.43 wt. % of feed. After separation of the water phase from the quenched mixture, the gaseous mixture, now relatively free of solid material, is compressed and mixed with the remaining steam from the indirect heat exchanger in order to increase the steam in the lift gas to the desired rate. The lift gas is then mixed with hot regenerated catalyst to contact the feed in the manner previously described.

We claim:

1. A process for the fluidized catalytic cracking (FCC) of hydrocarbons said process comprising:

(a) contacting hot regenerated catalyst particles, lift gas and an FCC feed in an upstream end of a riser conversion zone at hydrocarbon conversion conditions;

(b) passing an effluent mixture of hydrocarbon vapors, steam and spent catalyst particles from a downstream end of said riser conversion zone to a fluid solid separator, separating hydrocarbon vapors and steam from said separator, withdrawing the separated hydrocarbon vapors and steam from said process and passing the separated catalyst particles to a stripping zone;

(c) contacting catalyst particles in said stripping zone with a stripping fluid comprising steam to displace adsorbed material comprising hydrocarbons from the surface of said particles and collecting a gaseous mixture of desorbed material and stripping fluid;

(d) withdrawing at least a portion of the gaseous mixture from the stripping zone, cooling said gaseous mixture and separating solid particles from said mixture; and (e) compressing said mixture and passing said mixture to said riser conversion zone as said lift gas.

2. The process of claim 1 wherein said effluent mixture passes in closed communication from said riser conversion zone to a cyclone separator and essentially all of said hydrocarbon vapors and steam are withdrawn from the process by said cyclone separator.

3. The process of claim 2 wherein said gaseous mixture has a temperature of about 850°-1010° F.

4. The process of claim 1 wherein hot regenerated catalyst particles are mixed with the spent catalyst particles in said stripping zone and said gaseous mixture comprises hydrogen, steam and light hydrocarbons.

5. The process of claim 4 wherein said gaseous mixture has a temperature in a range of from 950°-1200° F.

6. The process of claim 1 wherein said gaseous mixture is first cooled by indirect heat exchange with a heat exchange fluid and then quenched by direct contact with water.

7. The process of claim 6 wherein said indirect heat exchange generates steam and cools said gaseous mixture to a temperature of less than 650° F. and said direct contact with water cools said mixture to a temperature of less than 300° F.

8. The process of claim 6 wherein solid particles are removed from said gaseous mixture upstream of said indirect heat exchange in a cyclone separator.

9. The process of claim 6 wherein said direct contact with water scrubs solid particles from said gaseous mixture and said quenched solids enter a separator that withdraws condensed materials from said gaseous mixture.

10. The process of claim 7 wherein said gaseous mixture is combined with steam from said indirect heat exchange after it is compressed and before said mixture is passed to said riser conversion zone.

11. The process of claim 1 wherein said stripping zone includes a first stripping section and a second stripping section, the mixing of said spent catalyst particles and hot regenerated catalyst particles is carried out in said second stripping section and said first and second stripping sections are divided so that said gaseous mixture consists essentially of steam and stripped material from said second section.

12. A process for the fluidized catalytic cracking (FCC) of hydrocarbons in a riser conversion zone said process comprising:

(a) contacting regenerated catalyst in an upstream portion of said riser conversion zone with a lift gas comprising hydrocarbons and steam, said hydrocarbons in said lift gas comprising $C_3$ and lower molecular weight hydrocarbons, and contacting a regenerated catalyst and lift gas mixture with an FCC feedstock in said riser conversion zone at a location downstream of the lift gas and catalyst contacting;

(b) discharging an effluent mixture comprising lift gas, hydrocarbons and spent catalyst from a downstream end of said riser conversion zone said downstream end having a location in a reactor vessel;

(c) collecting said effluent mixture in a separator, separating spent catalyst from said effluent mixture and withdrawing the rest of said effluent mixture from said reactor vessel;

(d) passing said spent catalyst downwardly from said reactor vessel into a stripper vessel, counter-currently contacting said spent catalyst with a stream of stripping steam to remove adsorbed hydrocarbons from the surface of said catalyst and withdrawing spent catalyst from the bottom of said stripper vessel;

(e) passing steam and hydrocarbons desorbed from the surface of said catalyst upwardly into said reactor vessel and withdrawing a gaseous mixture, having a temperature of at least 850° F. and comprising steam and material stripped from said spent catalyst, out of an upper section of said reaction vessel;

(f) cooling said gaseous mixture by indirect heat exchange with a feed water stream to generate steam and produce a cooled mixture having a temperature of less than 650° F;

(g) contacting the cooled mixture with a water stream to produce a quenched mixture having a temperature of less than 300° F. and scrub solid particles from said quenched mixture;

(h) separating condensed liquid from said quenched mixture to remove liquid and solids and produce a separator gas stream;

(i) compressing said separator gas stream to a pressure of between 15 to 50 psig; and (j) combining said separator gas with steam to produce the lift gas of step (a).

13. The process of claim 12 wherein said effluent mixture is discharged in closed communication into said separator.

14. The process of claim 12 wherein hot regenerated catalyst is mixed with said spent catalyst by adding said hot regenerated catalyst to a central section of said stripping zone.

15. The process of claim 12 wherein said gaseous mixture passes through a cyclone type separator before it is cooled by indirect heat exchange.

16. The process of claim 12 wherein said lift gas contains on a water-free basis less than 10 wt. % of $C_3$ and heavier hydrocarbons.

* * * * *